US011168704B2

(12) United States Patent
Mito et al.

(10) Patent No.: US 11,168,704 B2
(45) Date of Patent: Nov. 9, 2021

(54) VARIABLE STATOR VANE AND COMPRESSOR

(71) Applicant: Mitsubishi Hitachi Power Systems, Ltd., Kanagawa (JP)

(72) Inventors: Ryosuke Mito, Tokyo (JP); Hidetaka Okui, Yokohama (JP)

(73) Assignee: MITSUBISHI POWER, LTD., Kanagawa (JP)

( * ) Notice: Subject to any disclaimer, the term of this patent is extended or adjusted under 35 U.S.C. 154(b) by 71 days.

(21) Appl. No.: 16/498,069

(22) PCT Filed: Mar. 30, 2018

(86) PCT No.: PCT/JP2018/013732
§ 371 (c)(1),
(2) Date: Sep. 26, 2019

(87) PCT Pub. No.: WO2018/181939
PCT Pub. Date: Oct. 4, 2018

(65) Prior Publication Data

US 2021/0115946 A1 Apr. 22, 2021

(30) Foreign Application Priority Data

Mar. 30, 2017 (JP) ..... JP2017-066611

(51) Int. Cl.
*F04D 29/56* (2006.01)
*F01D 9/04* (2006.01)
*F01D 17/16* (2006.01)

(52) U.S. Cl.
CPC ..... *F04D 29/563* (2013.01); *F01D 9/042* (2013.01); *F01D 17/162* (2013.01); *F05D 2240/12* (2013.01); *F05D 2240/121* (2013.01)

(58) Field of Classification Search
CPC ..... F04D 29/563; F01D 9/042; F01D 17/162; F05D 2240/12; F05D 2240/121
See application file for complete search history.

(56) References Cited

U.S. PATENT DOCUMENTS 4,604,030 A 8/1986 Naudet
4,834,613 A 5/1989 Hansen et al.
(Continued)

FOREIGN PATENT DOCUMENTS

CN 1420258 5/2003
EP 1312764 5/2003
(Continued)

OTHER PUBLICATIONS

International Search Report dated Jun. 19, 2018 in International (PCT) Patent Application No. PCT/JP2018/013732, with English Translation.
(Continued)

*Primary Examiner* — Audrey B. Walter
(74) *Attorney, Agent, or Firm* — Wenderoth, Lind & Ponack, L.L.P.

(57) ABSTRACT

A stator vane body which is disposed in a flow path through which a working fluid flows and by which a clearance is formed between the stator vane body and an inner casing; a rotary shaft which is configured to rotate such that an angle of the stator vane body with respect to a flow direction of a main flow of the working fluid is varied; and a connection part which is configured to connect the stator vane body to the rotary shaft are provided. The connection part includes a first guide surface which is configured to guide the working fluid in a direction in which a flow direction of a leakage flow of the working fluid in the clearance which has flowed into toward a leading edge side of the stator vane body is directed in a flow direction of the main flow.

12 Claims, 10 Drawing Sheets

(56) References Cited

U.S. PATENT DOCUMENTS

| | | | | |
|---|---|---|---|---|
| 5,752,802 | A * | 5/1998 | Jones | F01D 5/20 415/170.1 |
| 6,129,512 | A | 10/2000 | Agram et al. | |
| 2003/0170115 | A1 | 9/2003 | Bowen et al. | |
| 2005/0232756 | A1 | 10/2005 | Cormier et al. | |
| 2008/0101935 | A1 | 5/2008 | Clouse et al. | |
| 2008/0253882 | A1 | 10/2008 | Major et al. | |
| 2009/0238682 | A1* | 9/2009 | Clemen | F01D 11/001 415/159 |
| 2010/0232936 | A1* | 9/2010 | Mielke | F01D 17/162 415/160 |
| 2013/0259658 | A1 | 10/2013 | Dube et al. | |
| 2015/0167490 | A1* | 6/2015 | Hennequin | F04D 29/542 415/160 |
| 2015/0285085 | A1 | 10/2015 | Bentley | |
| 2016/0076548 | A1 | 3/2016 | Reynolds et al. | |
| 2016/0160874 | A1 | 6/2016 | Lamicq et al. | |
| 2017/0234152 | A1* | 8/2017 | Jones | F01D 17/162 415/151 |

FOREIGN PATENT DOCUMENTS

| | | |
|---|---|---|
| FR | 2966530 | 4/2012 |
| JP | 60-145500 | 7/1985 |
| JP | 11-315702 | 11/1999 |
| JP | 2000-345997 | 12/2000 |
| JP | 2002-138997 | 5/2002 |
| JP | 2003-193999 | 7/2003 |
| JP | 2005-299667 | 10/2005 |
| JP | 2012-233424 | 11/2012 |

OTHER PUBLICATIONS

Written Opinion of the International Searching Authority dated Jun. 19, 2018 in International (PCT) Patent Application No. PCT/JP2018/013732, with English Translation.

* cited by examiner

VARIABLE STATOR VANE AND COMPRESSOR

TECHNICAL FIELD

The present invention relates to a variable stator vane and a compressor.

Priority is claimed on Japanese Patent Application No. 2017-066611, filed Mar. 30, 2017, the content of which is incorporated herein by reference.

BACKGROUND ART

In the case of compressors, there are compressors which include a rotor body accommodated in a casing, a plurality of rotor blades arranged radially outward in a radial direction of the rotor body, and a plurality of variable stator vanes arranged alternately with the rotor blades in a direction in which the rotor body extends.

Patent Document 1 describes a variable stator vane which includes a stator vane body, a first blade shaft, and a second blade shaft. The stator vane body is disposed between an inner casing and an outer casing.

The first blade shaft is connected to a first end of the stator vane body. The first blade shaft is supported to be swingable with respect to the inner casing. The second blade shaft is connected to a second end of the stator vane body. The second blade shaft is supported to be swingable with respect to the outer casing.

When the variable stator vane having such a constitution is applied to a compressor, clearances are formed between an outer circumferential surface of the inner casing and a first end surface of the stator vane body and between an inner circumferential surface of the outer casing and a second end surface of the stator vane body.

It should be noted that diameter-enlarged parts having a disk shape and a diameter larger than those of the blade shafts are provided between the stator vane body and the blade shafts in the variable stator vane.

CITATION LIST

Patent Document

[Patent Document 1]

Japanese Unexamined Patent Application, First Publication No. 2012-233424

SUMMARY OF INVENTION

Technical Problem

Incidentally, a leakage flow (a jet flow) is generated in a portion of the clearance formed between the first end surface of the stator vane body and the inner circumferential surface of the inner casing, which is located on a leading edge side of the stator vane body in a direction crossing a main flow of a working fluid (a direction from a pressure surface side toward a suction surface side).

When this leakage flow interferes with the main flow of the working fluid, vortices are generated. Furthermore, the vortices roll up along the suction surface of the stator vane body, which is likely to cause the pressure loss in some cases.

It should be noted that it is also conceivable that the diameter of the above-mentioned disk-shaped diameter-enlarged part be increased to cover the leading edge side of the first end surface of the stator vane body, and thus a clearance be eliminated and the above-mentioned leakage loss minimized.

However, when an outer diameter of a connection part is increased, an arrangement pitch of a variable stator vane is limited, and thus it is difficult to apply the variable stator vane when the arrangement pitch of the variable stator vane is narrow.

Therefore, an object of the present invention is to provide a variable stator vane and a compressor capable of minimizing the pressure loss even when an arrangement pitch of the variable stator vane is narrow.

Solution to Problem

In order to accomplish the above-described object, a variable stator vane according to an aspect of the present invention is a variable stator vane including: a stator vane body which is configured to be disposed in a flow path through which a working fluid flows and by which a clearance is configured to be formed between the stator vane body and an inner casing; a rotary shaft which is configured to rotate such that an angle of the stator vane body with respect to a flow direction of a main flow of the working fluid varies; and a connection part which connects the stator vane body and the rotary shaft, wherein the connection part includes a first guide surface which is configured to guide a leakage flow of the working fluid which has flowed into a side closer to a leading edge of the stator vane body in the clearance so that a flow direction of the leakage flow is directed to a flow direction of the main flow.

According to the present invention, since the first guide surface which is configured to guide the working fluid in the direction in which the flow direction of the leakage flow of the working fluid passing through the clearance formed on the leading edge side of the stator vane body is directed in the flow direction of the main flow is provided, it is possible to minimize the interference between the leakage flow of the working fluid which has passed through the clearance and the main flow of the working fluid.

Thus, since the generation of vortices caused due to the interference between the leakage flow of the working fluid and the main flow of the working fluid is minimized, it is possible to reduce the pressure loss.

Also, since it is not necessary to increase the outer diameter of the connection part, it is possible to reduce the pressure loss even when the arrangement pitch of the variable stator vane is narrow.

Furthermore, in a variable stator vane according to an aspect of the present invention, the first guide surface may be disposed in a portion of the connection part which is close to the leading edge of the stator vane body and close to a suction surface side of the stator vane body.

In this way, since the first guide surface is disposed in the portion of the connection part, which is on the leading edge side of the stator vane body and located on the suction surface side of the stator vane body, it is possible to guide the working fluid such that the flow direction of the leakage flow of the working fluid which has flowed into the clearance formed on the leading edge side of the stator vane body and has collided with the connection part is directed in the flow direction of the main flow.

Also, in a variable stator vane according to an aspect of the present invention, the first guide surface may be a curved surface which protrudes so as to approach the suction surface of the stator vane body In this way, since the first guide surface is the curved surface which protrudes toward the suction surface side of the stator vane body, the leakage flow of the working fluid can easily flow along the first guide surface, and it is possible to easily guide the working fluid in the direction in which the flow direction of the leakage flow is directed in the flow direction of the main flow.

Also, in a variable stator vane according to an aspect of the present invention, the connection part may include a cutout part which includes the first guide surface.

With such a constitution, since it is not necessary to increase the diameter of the connection part, it is possible to reduce the pressure loss even when the arrangement pitch of the variable stator vane is narrow.

Furthermore, in a variable stator vane according to an aspect of the present invention, the connection part may include: a connection part body which connects the stator vane body and the rotary shaft; and a protruding part which is provided in a portion closet to the leading edge of the stator vane body with respect to the connection part body, protrudes from the connection part body while in contact with an end surface close to the leading edge of the stator vane body facing the inner casing, and includes the first guide surface.

Since the protruding part having such a constitution is provided, it is possible to minimize the collision of the main flow of the working fluid with the connection part body and it is possible to guide the working fluid in the direction in which the flow direction of the leakage flow of the working fluid is directed in the flow direction of the main flow. Thus, it is possible to reduce the pressure loss even when the arrangement pitch of the variable stator vane is narrow.

In addition, in a variable stator vane according to an aspect of the present invention, the protruding part may include a second guide surface disposed at a position close to a pressure surface of the stator vane body, and the first and second guide surfaces are formed such that a distance between the first guide surface and the second guide surface increases from a distal end of the protruding part toward a base end of the protruding part.

Since the first and second guide surfaces having such a constitution is provided, it is possible to guide the working fluid such that the main flow of the working fluid is divided into two flows before the working fluid collides with the connection part body using the first and second guide surfaces and the flow direction of the leakage flow of the working fluid which has passed on the leading edge side of the stator vane body is directed in the flow direction of the main flow using the first guide surface.

Also, in a variable stator vane according to an aspect of the present invention, a shape of a distal end portion of the protruding part may be a rounded shape.

In this way, since the shape of the distal end portion of the protruding part is a rounded shape, the distal end of the protruding part is not easily broken and it is possible to smoothly guide the working fluid toward the base end of the protruding part.

Furthermore, in a variable stator vane according to an aspect of the present invention, the protruding part may be provided to cover an entire of the end surface close to the leading edge of the stator vane body.

In this way, since the protruding part provided to cover the entire end surface on the leading edge side of the stator vane body is provided, it is possible to increase the length of the first guide surface. Moreover, it is possible to guide the working fluid in the direction in which the direction of the leakage flow of the working fluid is directed in the flow direction of the main flow when the working fluid has reached the leading edge of the stator vane body. Therefore, it is possible to further reduce the pressure loss.

In addition, in a variable stator vane according to an aspect of the present invention, the rotary shaft may include a rotary shaft body and a diameter-enlarged part which connects the rotary shaft body and the connection part and has a diameter larger than an outer diameter of the rotary shaft body, and the connection part has a shape in which a width of the connection part is wider from the stator vane body toward the diameter-enlarged part.

Since the diameter-enlarged part having such a constitution is provided, it is possible to enhance the connection strength between the connection part and the rotary shaft body.

Also, in a variable stator vane according to an aspect of the present invention, the rotary shaft may include a rotary shaft body and a diameter-enlarged part which connects the rotary shaft body and the connection part and has a diameter larger than an outer diameter of the rotary shaft body, and the protruding part is provided to cover at least a part of the end surface close to the leading edge of the stator vane body and is disposed to extend toward a side surface of the diameter-enlarged part.

In this way, since the protruding part is disposed to cover at least a part of the end surface of the leading edge side of the stator vane body and to extend to the side surface of the diameter-enlarged part, it is possible to cause the working fluid in the vicinity of the outer circumferential surface of the inner casing to collide with the protruding part.

In order to accomplish the above-mentioned object, a compressor according to an aspect of the present invention is a compressor including: the variable stator vane; a rotor which includes a rotor body and a plurality of rotor blades arranged in an axial direction and a circumferential direction of the rotor body; an inner casing provided outside the rotor; an outer casing provided outside the inner casing; and a rotation driving part which is connected to a rotary shaft and is configured to rotate the rotary shaft, wherein the inner casing includes a shaft accommodation part which has the rotary shaft accommodated therein.

According to the compressor having such a constitution, since the above-mentioned variable stator vane is provided, it is possible to minimize the pressure loss even when the arrangement pitch of the variable stator vane is narrow.

In order to accomplish the above-mentioned object, a compressor according to an aspect of the present invention is a compressor including: the variable stator vane; a rotor which includes a rotor body and a plurality of rotor blades arranged in an axial direction and a circumferential direction of the rotor body; an inner casing provided outside the rotor; an outer casing provided outside the inner casing; and a rotation driving part which is connected to a rotary shaft and is configured to rotate the rotary shaft, wherein the inner casing includes a shaft accommodation part which has the rotary shaft accommodated therein and a chamfered part which defines a gap between a protruding part and the inner casing, and a chamfered surface of the chamfered part is connected to a side surface of the shaft accommodation part.

In this way, since the gap is formed between the protruding part and the inner casing and the chamfered part having the chamfered surface connected to the side surface of the shaft accommodation part is provided, it is possible to guide the working fluid into the gap. Thus, it is possible to more reliably guide the working fluid such that the flow direction of the leakage flow is directed in the flow direction of the main flow.

Furthermore, in a compressor according to an aspect of the present invention, the variable stator vane may include another rotary shaft which is connected to the stator vane body located on a side opposite from a side on which the rotary shaft is provided and rotatably supported by the outer casing.

It is possible to minimize the pressure loss even when the variable stator vane is applied to the compressor having such a constitution.

Advantageous Effects of Invention

According to the present invention, it is possible to minimize the pressure loss due to a leakage flow of a working fluid even when an arrangement pitch of a variable stator vane is narrow.

DESCRIPTION OF EMBODIMENTS

Embodiments to which the present invention is applied will be described below in detail with reference to the drawings.

First Embodiment

Figure 1:
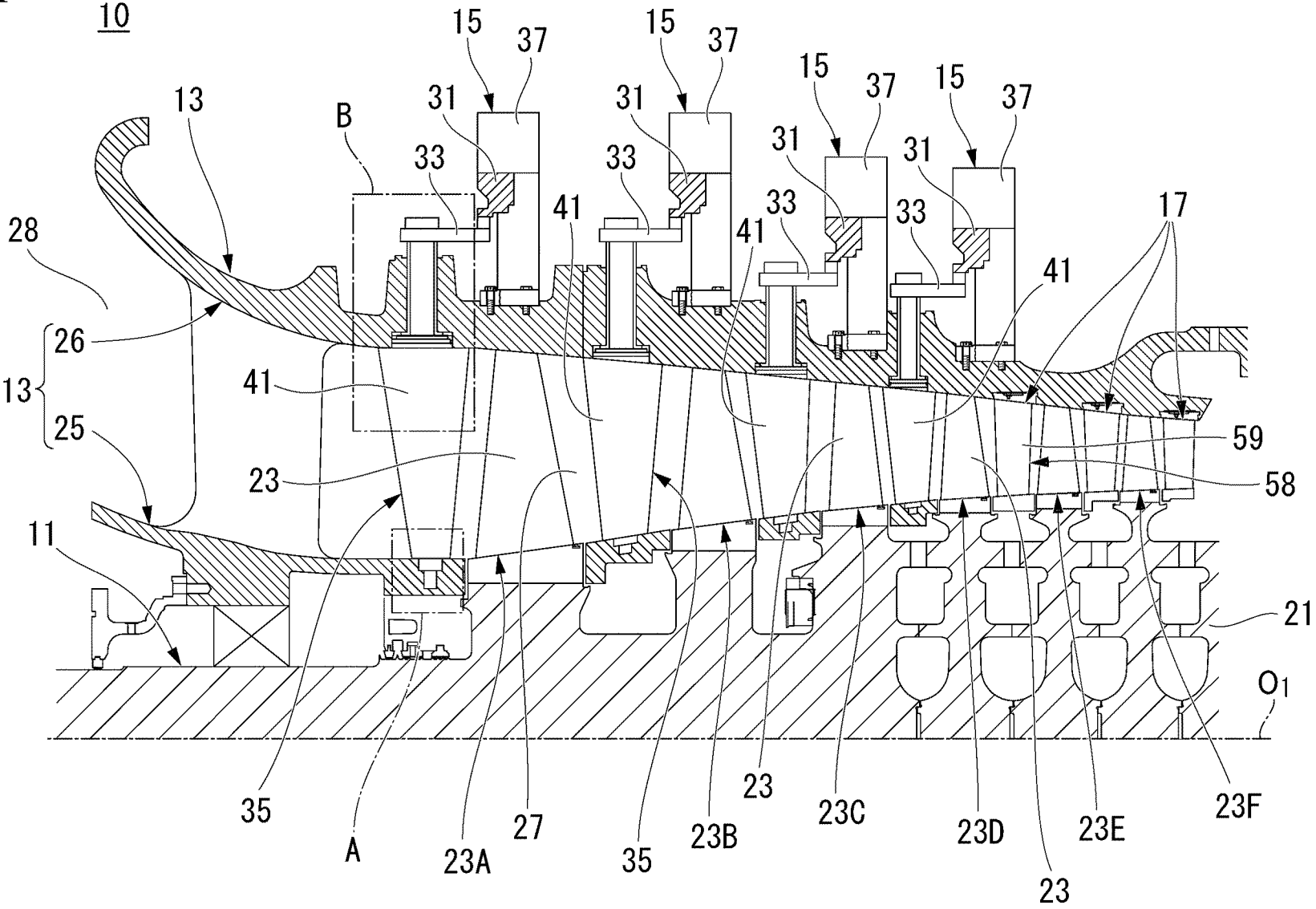
FIG. 1 is a cross-sectional view of a main part (an upper half on a suction port side) of a compressor according to a first embodiment of the present invention.

A compressor 10 according to a first embodiment will be described with reference to FIGS. 1 to 3. In FIG. 1, an axial flow compressor is shown as an example of the compressor 10. FIG. 1 shows cross sections of only a casing 13 and a rotor 11. In FIG. 1, $O_1$ indicates an axis of the rotor 11 (hereinafter referred to as an "axis $O_1$"). Furthermore, in FIG. 1, since it is difficult to show a clearance $CL_2$ shown in FIG. 2 and a clearance $CL_1$ shown in FIG. 3, the clearance $CL_2$ and the clearance CU are not shown.

Figure 2:
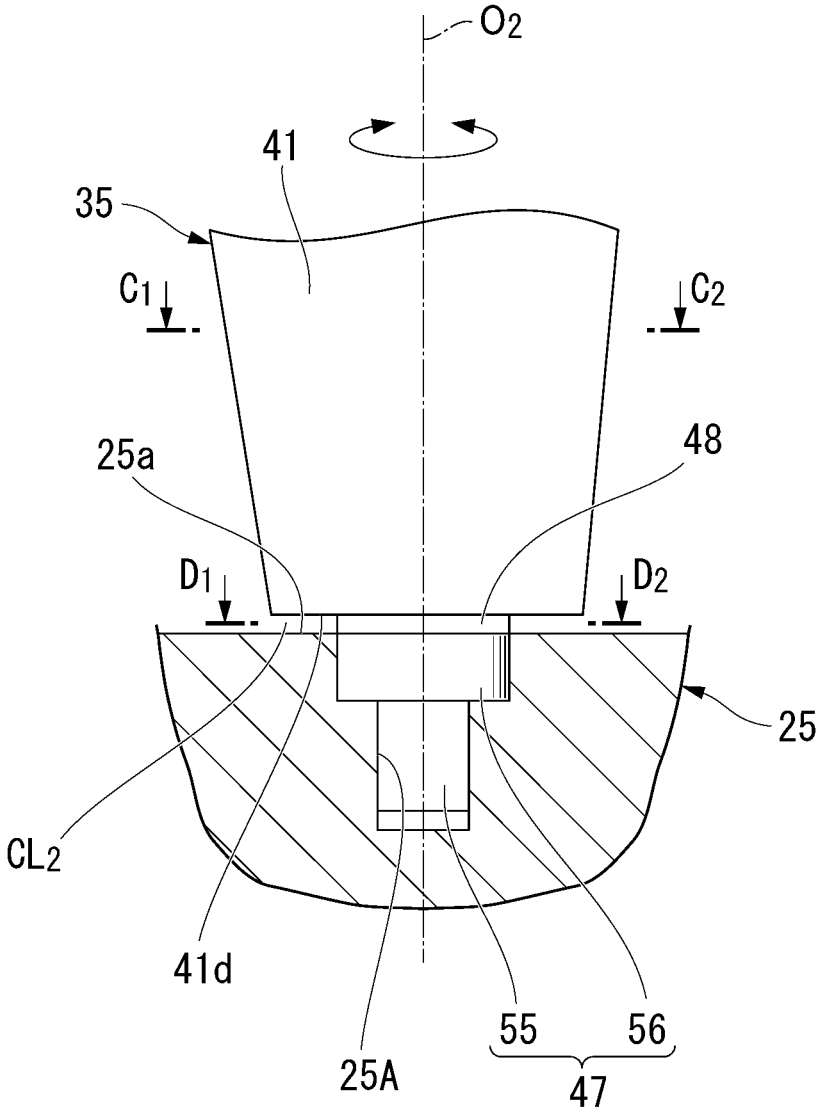
FIG. 2 is an enlarged cross-sectional view of a portion of the compressor shown in FIG. 1 surrounded by a region A.
Figure 3:
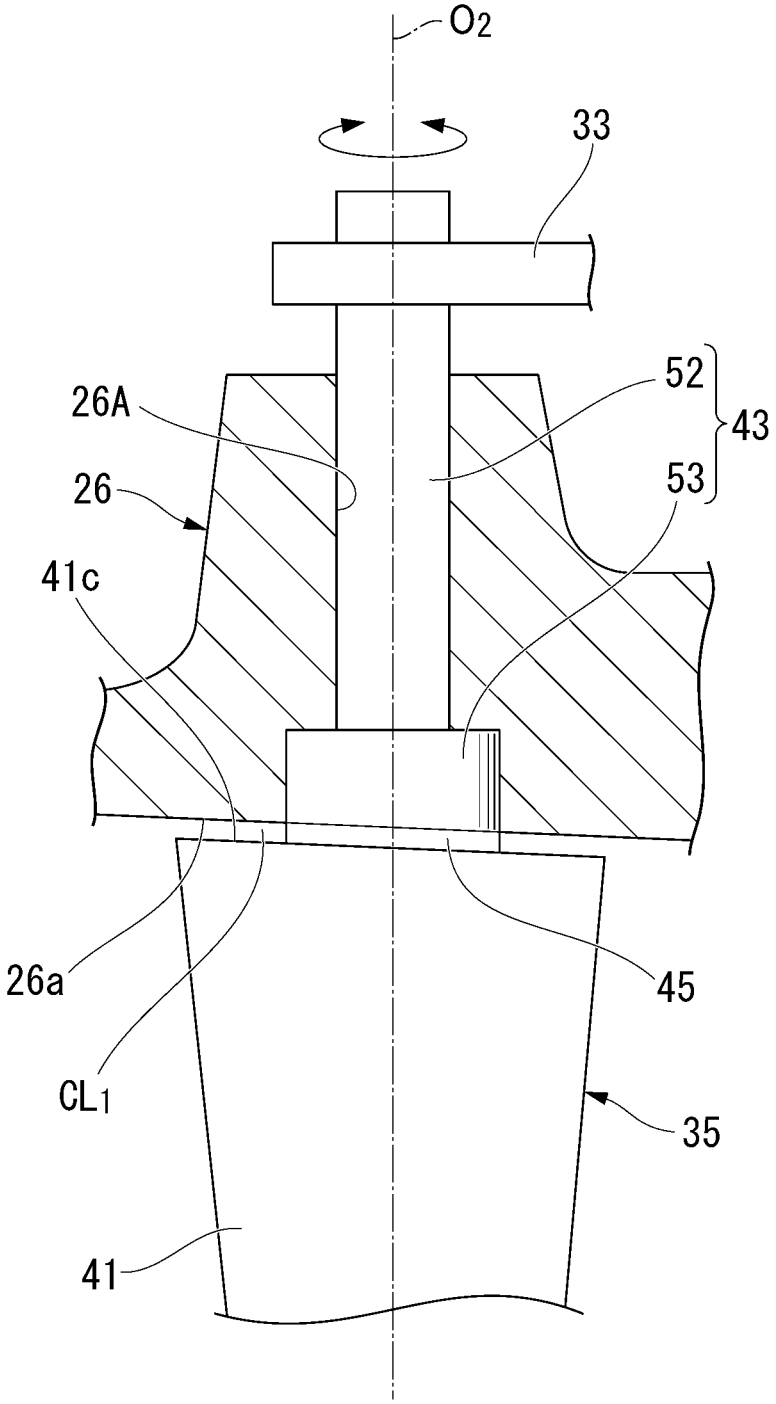
FIG. 3 is an enlarged cross-sectional view of a portion of the compressor shown in FIG. 1 surrounded by a region B.

In FIGS. 2 and 3, $O_2$ indicates an axis of rotary shafts 43 and 47 (hereinafter referred to as an "axis $O_2$").

The compressor 10 includes the rotor 11, the casing 13, a plurality of variable stator vane mechanisms 15, and a plurality of stator vane groups 17.

The rotor 11 includes the rotor body 21, a plurality of rotor blades 23, and first to sixth rotor blade groups 23A to 23F constituted of the plurality of rotor blades 23.

The rotor body 21 is a columnar member and extends in one direction. The rotor body 21 has a constitution in which a plurality of rotor disks (not shown) are stacked. The rotor body 21 is rotatably supported by a bearing (not shown).

A plurality of rotor blades 23 are provided for each of the plurality of rotor disks. The plurality of rotor blades 23 provided in each of the rotor disks extend radially from outer circumferential surfaces of the rotor disks.

The first rotor blade group 23A is provided in a first rotor disk disposed at a position of each of the plurality of rotor disks closest to a suction port 28 side. The first rotor blade group 23A is constituted of the plurality of rotor blades 23 arranged in a circumferential direction of the first rotor disk.

The second rotor blade group 23B is provided in the second rotor disk of the first rotor disk disposed on a discharge port side. The third rotor blade group 23C, the fourth rotor blade group 23D, the fifth rotor blade group 23E, and the sixth rotor blade group 23F are sequentially provided on the discharge port side of the second rotor disk in a state with predetermined intervals therebetween with respect to a direction from the suction port 28 toward the discharge port.

It should be noted that, although only the first to sixth rotor blade groups 23A to 23F are shown in FIG. 1 in view of space limitations, the plurality of rotor blade groups are also arranged in an axis $O_1$ direction on the discharge port side of the sixth rotor blade group 23F.

The casing 13 includes an inner casing 25 and an outer casing 26.

The inner casing 25 is a tubular member disposed outside the rotor 11. The inner casing 25 includes shaft accommodation parts 25A in which a rotary shaft 43 of a variable stator vane 35 constituting the variable stator vane mechanisms 15 is accommodated. The plurality of shaft accommodation parts 25A are provided in the circumferential direction and the axis $O_1$ direction of the inner casing 25. The inner casing 25 supports a first end side (one end side) of each of the variable stator vanes 35 in a state in which the rotary shaft 43 is rotatable.

The outer casing 26 is a tubular member disposed outside the inner casing 25. The outer casing 26 includes shaft accommodation parts 26A in which the rotary shaft 43 of the variable stator vane 35 constituting the variable stator vane mechanisms 15 is accommodated. The plurality of shaft accommodation parts 26A are provided in the circumferential direction and the axis $O_1$ direction of the outer casing 26.

The outer casing 26 supports the other end of the variable stator vane 35 in a state in which the rotary shaft 43 is rotatable. A tubular flow path 27 is defined between the outer casing 26 and the inner casing 25.

The casing 13 includes the suction port 28 and a discharge port (not shown). The suction port 28 is provided on a first side (one side) of the axis $O_1$. The suction port 28 communicates with the flow path 27. A working fluid (for example, outside air) is suctioned into the casing 13 through the suction port 28.

The discharge port is provided on a second side (0the other side) of the axis $O_1$. The discharge port communicates with the flow path 27. A working fluid which has been compressed in the casing 13 is discharged to the outside of the casing 13 through the discharge port.

The plurality of variable stator vane mechanisms 15 are provided in the first to the fourth rotor blade group 23A to 23D on the suction port 28 side.

A constitution of the variable stator vane mechanisms 15 will be described below with reference to FIGS. 1 and 2. Constituent elements in FIG. 2 that are the same as those shown in FIG. 1 will be denoted with the same reference numerals as those shown in FIG. 1.

The plurality of (four as an example in the case of FIG. 1) variable stator vane mechanisms 15 are provided in the axis $O_1$ direction in a state of being separated from each other.

The variable stator vane mechanisms 15 include movable rings 31, the plurality of link mechanisms 33, the plurality of variable stator vanes 35, and rotation driving parts 37.

Each of the movable rings 31 is an annular member. The movable ring 31 is provided outside the casing 13 to surround the casing 13.

The plurality of link mechanisms 33 are arranged at predetermined intervals in a circumferential direction of the movable ring 31. A first end (one end) of each of the plurality of link mechanisms 33 is fixed to the movable ring 31. A second end (the other end) of each of the plurality of link mechanisms 33 protrudes toward the suction port 28 side.

Figure 4:
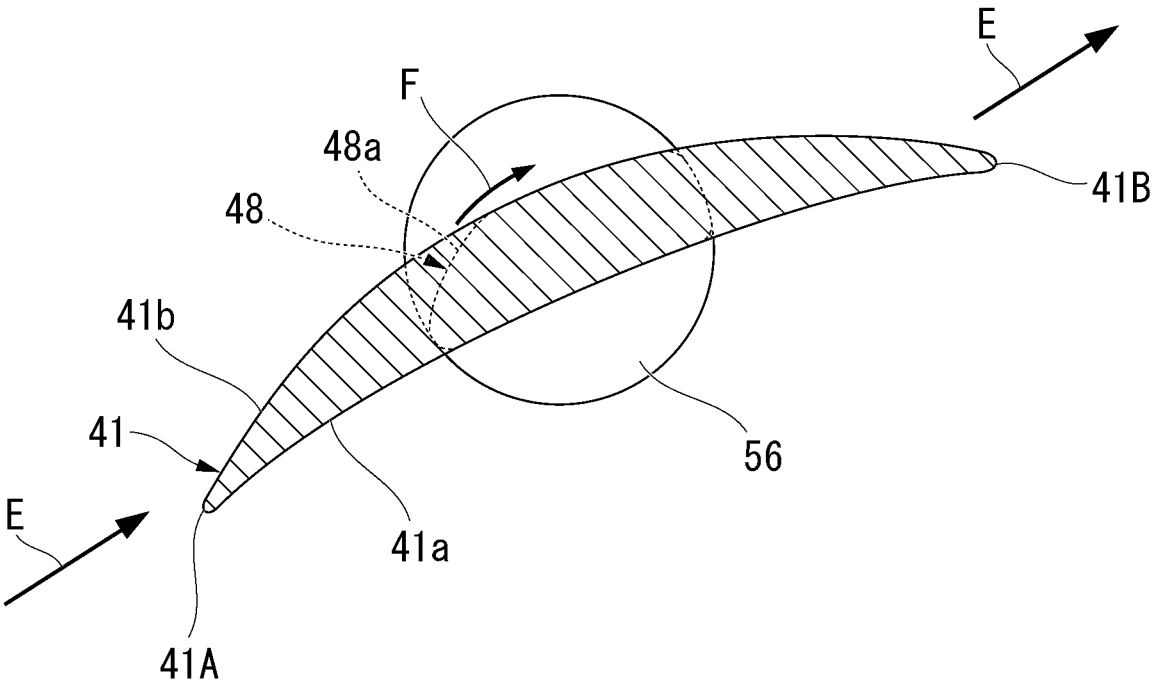
FIG. 4 is a cross-sectional view of a structure shown in FIG. 2 in a $C_1$-$C_2$ line direction.
Figure 5:
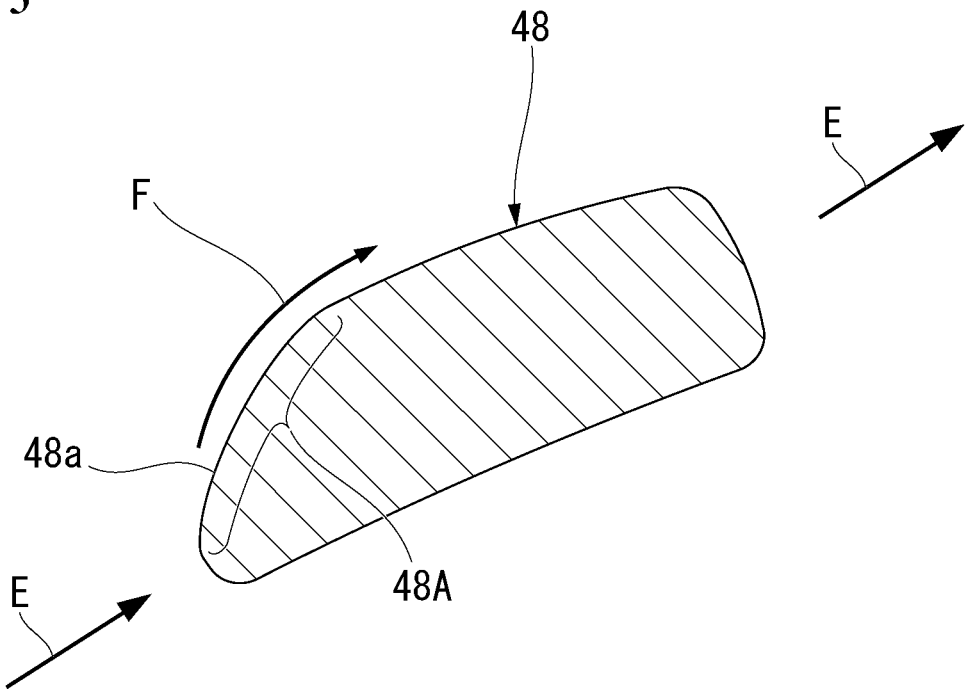
FIG. 5 is a cross-sectional view of the structure shown in FIG. 2 in a $D_1$-$D_2$ line direction.

The variable stator vane 35 will be described with reference to FIGS. 1 to 5. In FIGS. 4 and 5, a flow direction of a main flow of a working fluid is denoted with E (hereinafter referred to as an "E direction") and a flow direction of a leakage flow of a working fluid flowing along a first guide surface 48*a* is denoted with F (hereinafter referred to as an "F direction"). Constituent elements in FIG. 4 that are the same as those shown in FIGS. 1 to 3 will be denoted with the same reference numerals as those shown in FIGS. 1 to 3. Constituent elements in FIG. 5 that are the same as those shown in FIG. 4 will be denoted with the same reference numerals as those shown in FIG. 4.

The variable stator vane 35 includes a stator vane body 41, the rotary shafts 43 and 47, and connection parts 45 and 48.

The stator vane body 41 is a blade-shaped member. The stator vane body 41 is disposed between the inner casing 25 and the outer casing 26. The stator vane body 41 includes a pressure surface 41*a*, a suction surface 41*b*, a leading edge 41A, a trailing edge 41B, a second end surface 41*c*, and a first end surface 41*d*.

The leading edge 41A forms a first end configured to join the pressure surface 41*a* to the suction surface 41*b*. The trailing edge 41B forms a second end configured to join the pressure surface 41*a* to the suction surface 41*b*. The pressure surface 41*a* and the suction surface 41*b* are curved surfaces.

The second end surface 41*c* is an end surface on a side closer to the leading edge 41A the stator vane body 41 facing an inner circumferential surface 26*a* of the outer casing 26. The clearance $CL_1$ is formed between a portion of the second end surface 41*c* in which the connection part 45 is not provided and the inner circumferential surface 26*a*.

The first end surface 41*d* is an end surface on a side closer to the leading edge 41A of the stator vane body 41 facing an outer circumferential surface 25*a* of the inner casing 25. The clearance $CL_2$ is formed between a portion of the first end surface 41*d* in which a connection part 48 is not provided and the outer circumferential surface 25*a*.

The rotary shaft 43 (another rotary shaft) has a rotary shaft body 52 and a diameter-enlarged part 53. The rotary shaft body 52 is a columnar member extending in one direction. The rotary shaft body 52 has a first end side arranged in the shaft accommodation part 26A and a second end side protruding outside the outer casing 26. The second end of the rotary shaft body 52 is fixed to the second end of the link mechanisms 33.

The rotary shaft 43 rotates in an arrow direction shown in FIG. 3 when the movable ring 31 is driven to rotate in the circumferential direction thereof using each of the rotation driving parts 37, thereby varying an angle of the stator vane body 41 with respect to the flow direction E of the main flow of the working fluid.

The diameter-enlarged part 53 is formed integrated with the first end of the rotary shaft body 52. The diameter-enlarged part 53 has a diameter larger than an outer diameter of the rotary shaft body 52. The diameter-enlarged part 53 connects the first end of the rotary shaft body 52 and the connection part 45.

In this way, since the diameter-enlarged part 53 which connects the first end of the rotary shaft body 52 and the connection part 45 is provided, it is possible to improve connection strength between the rotary shaft body 52 and the connection part 45.

The connection part 45 is provided between the second end of the stator vane body 41 and the diameter-enlarged part 53. The connection part 45 is integrally formed with the second end of the stator vane body 41. The connection part 45 has a shape in which a width of the connection part 45 is wider from the second end surface 41*c* of the stator vane body 41 toward the diameter-enlarged part 53.

A rotary shaft 47 includes a rotary shaft body 55 and the diameter-enlarged part 56. The rotary shaft body 55 is a columnar member extending in one direction. A entire of the rotary shaft body 55 is disposed in the shaft accommodation parts 25A.

The diameter-enlarged part 56 is formed integrally with first end of the rotary shaft body 55. The diameter-enlarged part 56 has a diameter larger than an outer diameter of the rotary shaft body 55. The diameter-enlarged part 56 connects the first end of the rotary shaft body 55 and the connection part 48.

In this way, since the diameter-enlarged part 56 which connects the first end of the rotary shaft body 55 and the connection part 48 is provided, it is possible to improve connection strength between the rotary shaft body 55 and the connection part 48.

The connection part 48 is provided between the second end of the stator vane body 41 and the diameter-enlarged part 53. The connection part 45 is formed integrally with the second end of the stator vane body 41. The connection part 45 has a shape in which a width of the connection part 45 is wider from the second end surface 41*c* of the stator vane body 41 toward the diameter-enlarged part 53.

The connection part 48 has a cutout part 48A. The cutout part 48A has the first guide surface 48*a*. The first guide surface 48*a* extends from the leading edge side toward the trailing edge side as it goes from the pressure surface 41*a* toward the suction surface 41*b* side. A first guide surface 48*a* is formed at a position at which the first guide surface 48*a* and the stator vane body 41 overlap when viewed from a radial direction. To be specific, the first guide surface 48*a* is formed to recede from the suction surface 41*b* when viewed from a radial direction.

The first guide surface 48*a* guides a leakage flow of the working fluid which has flowed into a side closer to the leading edge 41A of the stator vane body 41 in a portion of the clearance $CL_2$ so that a flow direction of the leakage flow is directed in the flow direction E of the main flow.

The first guide surface 48*a* is disposed in a portion of the connection part 48 which is close to the leading edge 41A of the stator vane body 41 and close to the suction surface 41*b* of the stator vane body 41. The first guide surface 48*a* is formed over the entire height direction of the connection part 48.

It should be noted that the "height direction of the connection part 48" is referred to as a direction in which the axis $O_2$ extends.

In this way, since the first guide surface 48*a* is disposed in a portion of the connection part 48 which is close to the leading edge 41A of the stator vane body 41 and close to the suction surface 41*b* of the stator vane body 41, it is possible to guide a flow direction of a leakage flow of a working fluid which has flowed into the clearance $CL_2$ at the position close to the leading edge 41A of the stator vane body 41 and has collided with the connection part 48 to the direction F in which the flow direction of the leakage flow of the working fluid is directed in the flow direction E of the main flow.

The first guide surface 48*a* may be, for example, a curved surface in which the first guide surface 48*a* protrudes so as to approach the suction surface 41*b* of the stator vane body 41.

In this way, since the first guide surface 48*a* is a curved surface in which the first guide surface 48*a* protrudes so as to approach the suction surface 41*b* of the stator vane body 41, the leakage flow of the working fluid easily flows along the first guide surface 48*a*. Thus, it is possible to easily guide the working fluid in the direction in which the flow direction of the leakage flow thereof is directed in the flow direction of the main flow.

It should be noted that the first guide surface 48*a* may be a surface orthogonal to the first end surface 41*d* of the stator vane body 41 and a surface intersecting the first end surface 41*d* of the stator vane body 41.

Also, a shape of the first guide surface 48*a* may be adopted as long as the shape is a shape in which the working fluid can be guided in a direction in which the flow direction of the leakage flow of the working fluid is directed in the flow direction of the main flow and is not limited to a curved surface.

Figure 6:
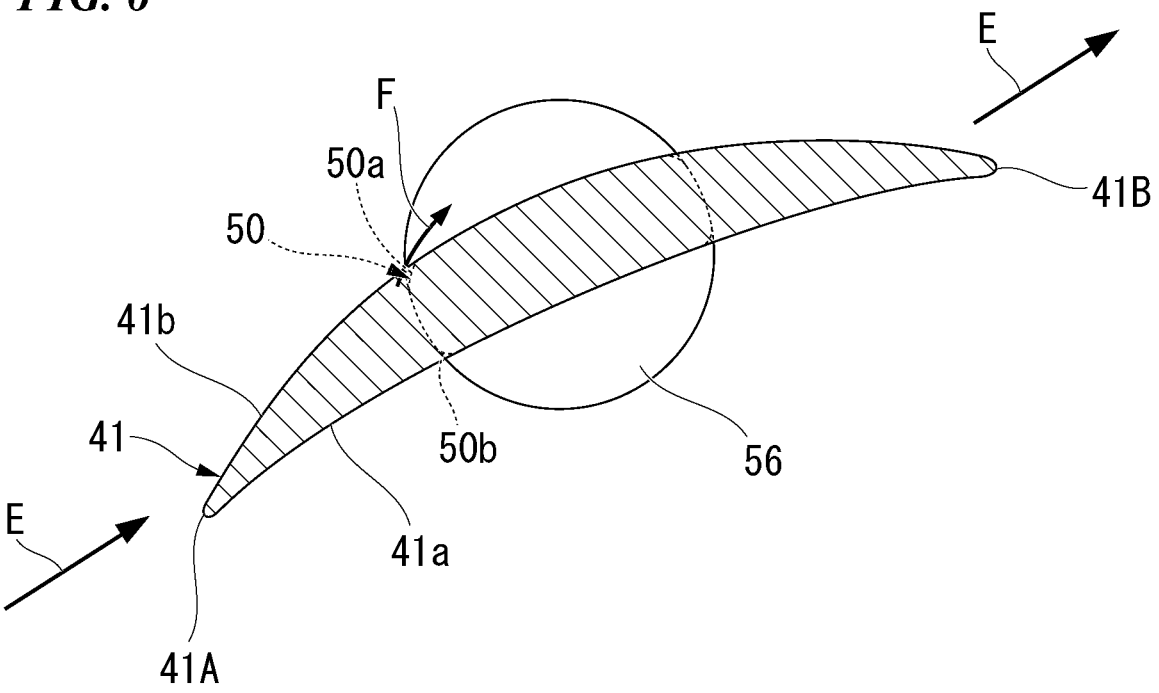
FIG. 6 is a cross-sectional view for explaining a connection part according to a modification of the first embodiment of the present invention.
Figure 7:
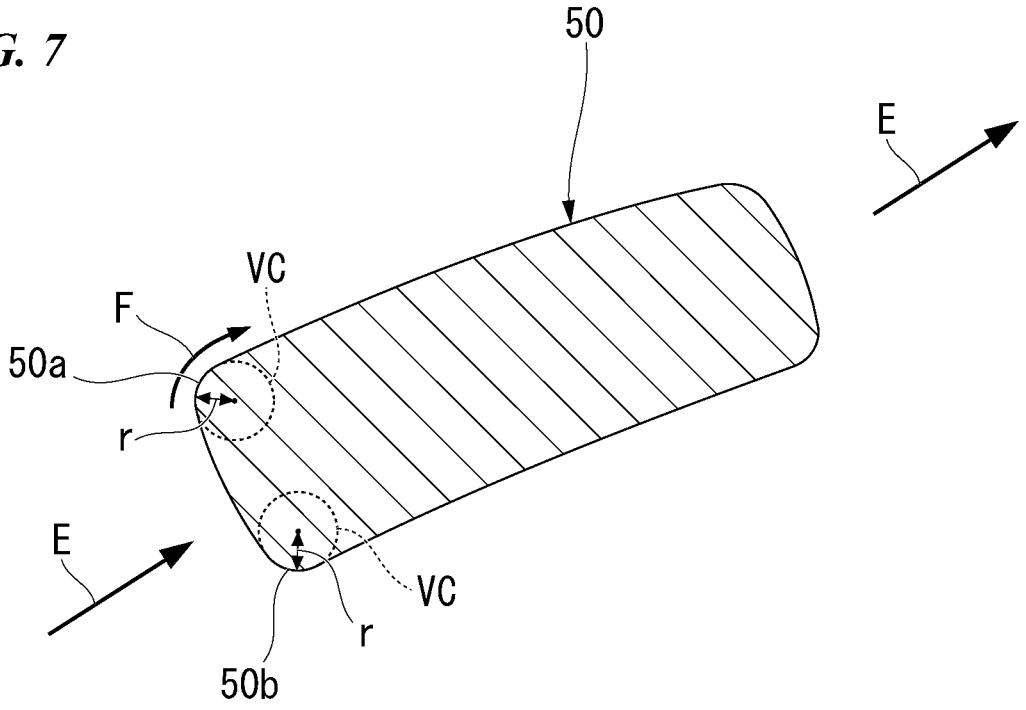
FIG. 7 is a cross-sectional view of the connection part shown in FIG. 6.

As an example of a connection part having a first guide surface with a shape different from that of the first guide surface 48*a*, for example, it is possible to exemplify a connection part 50 according to a modification of the first embodiment shown in FIGS. 6 and 7.

The connection part 50 will be described below with reference to FIGS. 6 and 7. Constituent elements in FIG. 6 that are the same as those shown in FIG. 4 will be denoted with the same reference numerals as those shown in FIG. 4. FIG. 6 shows a cross section of the stator vane body 48. In FIG. 7, a virtual circle will be denoted with VC (hereinafter referred to as a "virtual circle") and a radius of a virtual circle VC will be denoted with r (hereinafter referred to as a "radius r"). Constituent elements in FIG. 7 that are the same as those shown in FIG. 6 will be denoted with the same reference numerals as those shown in FIG. 6.

The connection part 50 is provided between the diameter-enlarged part 56 and the stator vane body 41 and has the first guide surface 50*a* and a surface 50*b* present closer to the pressure surface 41*a* side than a position at which the first guide surface 50*a* is formed.

The first guide surface 50*a* has a rounded round shape. The shape of the first guide surface 50*a* can be, for example, a shape in which the first guide surface 50*a* matches a part of the virtual circle VC with the radius r.

A shape of the surface 50*b* can also be the same shape as the first guide surface 50*a* described above.

It should be noted that, although a case in which the shape of the first guide surface 50*a* is the shape in which the first guide surface 50*a* matches a part of the virtual circle VC has been exemplified in FIGS. 6 and 7, the first guide surface having a shape different from this may be used.

To be specific, for example, the first guide surface formed in a linear shape when viewed in a plan view (in other words, the first guide surface which is a flat surface) may be used instead of a curved or round shape.

Even when the first guide surface having such a shape is used, it is possible to guide the working fluid in the direction in which the flow direction of the leakage flow of the working fluid is directed in the flow direction of the main flow.

Since the first guide surface 48*a* described above is provided, it is possible to minimize the interference between the leakage flow of the working fluid which has passed through the clearance $CL_2$ and the main flow of the working fluid. Thus, since the generation of vortices caused due to the interference between the leakage flow of the working fluid and the main flow of the working fluid is minimized, it is possible to reduce the pressure loss.

Also, since the first guide surface 48*a* is provided in the cutout part 48A, it is not necessary to increase an outer diameter of the connection part 48. Thus, even when an arrangement pitch of the variable stator vane 35 is narrow, it is possible to reduce the pressure loss.

It should be noted that, also when the first guide surface 50*a* described above is provided, it is possible to attain the same effect as in the first guide surface 48*a*.

The plurality of variable stator vanes 35 having the above-mentioned constitution are arranged in a radial direction of the movable ring 31 directed from the movable ring 31 toward the rotor 11 in a state in which the rotary shaft body 52 of each of the variable stator vanes 35 is fixed to the second end of the link mechanisms 33.

The rotation driving part 37 is provided outside the movable ring 31. The rotation driving part 37 rotates the movable ring 31 in the circumferential direction of the movable ring 31.

Since the variable stator vane mechanisms 15 having the above-mentioned constitution rotate the movable ring 31 using the rotation driving part 37 and rotate the entire of the variable stator vane 35 connected to each of the link mechanisms 33, angles of the plurality of stator vane bodies 41 with respect to the flow direction of the main flow of the working fluid can be varied to be desired angles.

It should be noted that, although a case in which the four variable stator vane mechanisms 15 are provided in the axis $O_1$ direction has been exemplified as an example in FIG. 1, the number of variable stator vane mechanisms 15 arranged in the axis $O_1$ direction may be one or more and is not limited to one.

The plurality of stator vane groups 17 are disposed at predetermined intervals on the discharge port side in a region in which the plurality of variable stator vane mechanisms 15 are disposed. Each of the stator vane groups 17 is constituted of a plurality of stator vanes 58 fixed to an inner surface of the outer casing 26 in a circumferential direction of the inner surface thereof. Each of the plurality of stator vanes 58 has a stator vane body 59. The stator vanes 58 are disposed in the flow path 27 and are disposed between the rotor blades 23 in the axis $O_1$ direction.

The stator vanes 58 constituting the plurality of stator vane groups 17 are configured such that angles of the plurality of stator vane bodies 59 with respect to the flow direction of the main flow of the working fluid cannot be varied.

According to the variable stator vane 35 in the first embodiment, since the cutout part 48A provided in the connection part 48 has the first guide surface 48*a*, it is possible to minimize the interference between the leakage flow of the working fluid which has passed through the clearance $CL_2$ and the main flow of the working fluid. Thus, since the generation of vortices caused due to the interference between the leakage flow of the working fluid and the main flow of the working fluid is minimized, it is possible to reduce the pressure loss.

Also, since the first guide surface 48*a* is provided in the cutout part 48A, it is not necessary to increase the outer diameter of the connection part 48. Thus, even when the arrangement pitch of the variable stator vane 35 is narrow, it is possible to reduce the pressure loss.

According to the compressor 10 in the first embodiment, since the variable stator vane 35 having the above-mentioned constitution is provided, even when the arrangement pitch of the variable stator vane 35 is narrow, it is possible to minimize the pressure loss.

It should be noted that, although a case in which the cutout part 48A including the first guide surface 48*a* is provided only in one connection part 48 has been exemplified in the first embodiment, the cutout part 48A including the first guide surface 48*a* may also be provided in the other connection part 45.

In this case, since it is possible to minimize the interference between the leakage flow of the working fluid which has passed through the clearance $CL_1$ and the main flow of the working fluid and it is possible to minimize the generation of vortices caused due to the interference between the leakage flow of the working fluid and the main flow of the working fluid, it is possible to reduce the pressure loss.

Also, a position of the connection part 48 with respect to the stator vane body 41 is not limited to the position shown in FIGS. 2 and 4. The position of the connection part 48 with respect to the stator vane body 41 may be adopted as long as the position is a position at which the clearance $CL_2$ is formed between the first end surface 41*d* of the stator vane body 41 and the outer circumferential surface 25*a* of the inner casing 25.

Second Embodiment

Figure 8:
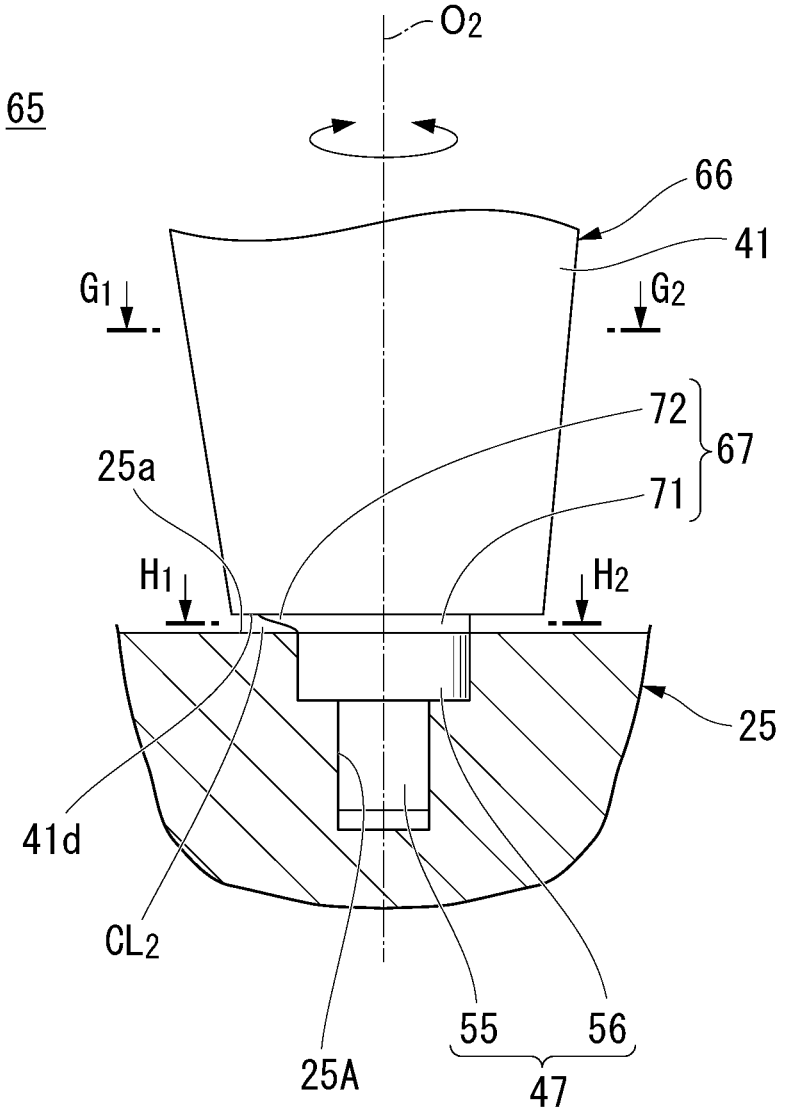
FIG. 8 is an enlarged cross-sectional view of a part of a compressor according to a second embodiment of the present invention.
Figure 9:
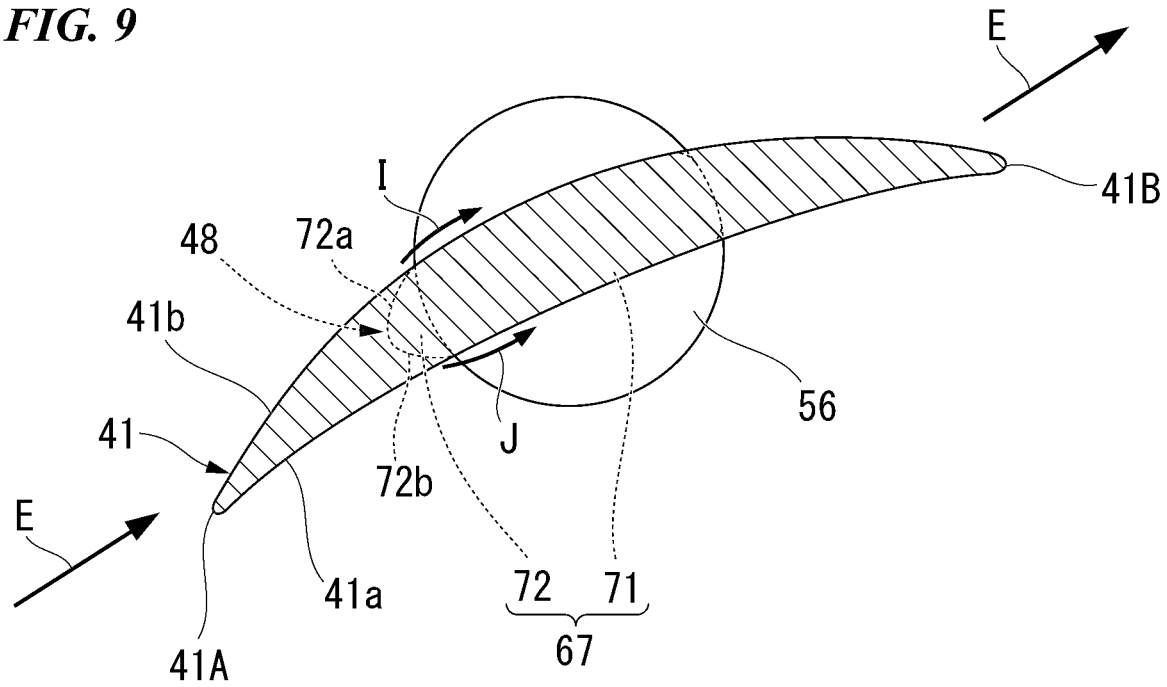
FIG. 9 is a cross-sectional view of a structure shown in FIG. 8 in a $G_1$-$G_2$ line direction.
Figure 10:
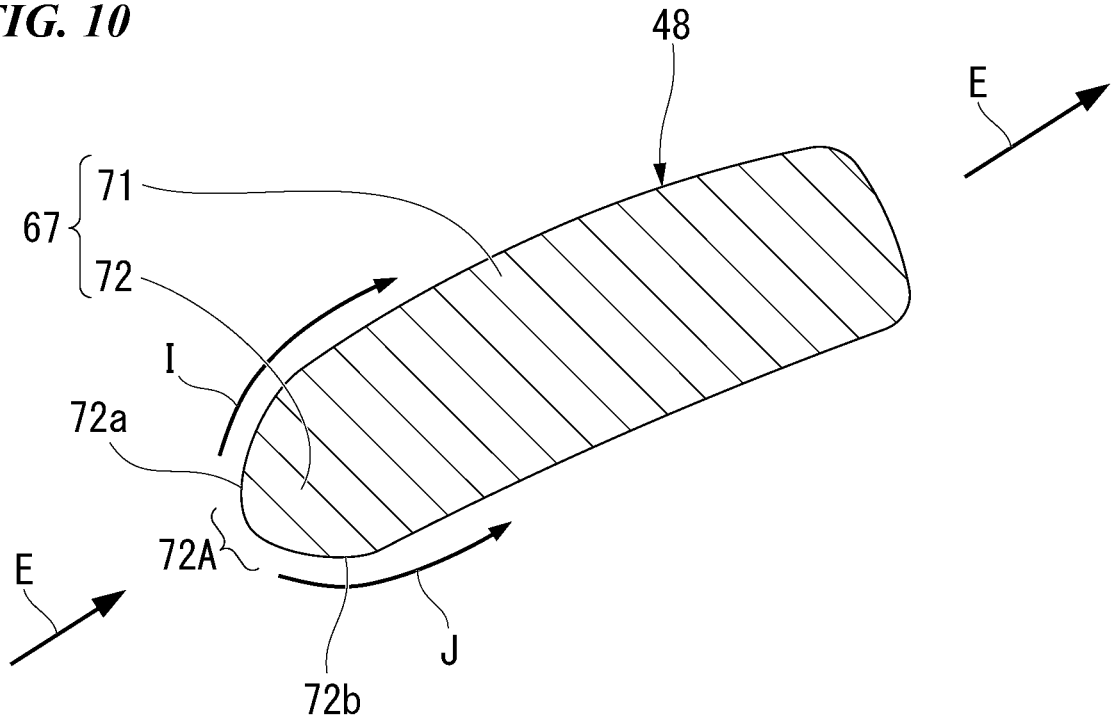
FIG. 10 is a cross-sectional view of the structure shown in FIG. 8 in an $H_1$-$H_2$ line direction.

A compressor 65 in a second embodiment will be described with reference to FIGS. 8 to 10. In FIGS. 9 and 10, a flow direction of a main flow of a working fluid will be denoted with E (hereinafter referred to as an "E direction"), a flow direction of a leakage flow of a working fluid flowing along a first guide surface 72*a* will be denoted with I (hereinafter referred to as an "I direction"), and a flow direction of a leakage flow of a working fluid flowing along a second guide surface 72*b* will be denoted with J (hereinafter referred to as a "J direction"). Constituent elements in FIGS. 8 to 10 that are the same as those shown in FIGS. 2 to 4 will be denoted with the same reference numerals as those shown in FIGS. 2 to 4.

The compressor 65 in the second embodiment is configured in the same manner as the compressor 10 except that a variable stator vane 66 is provided instead of the variable stator vane 35 constituting the compressor 10 in the first embodiment.

The variable stator vane 66 is configured in the same manner as the variable stator vane 35 except that a connection part 67 is provided instead of the connection part 48 constituting the variable stator vane 35 in the first embodiment.

The connection part 67 includes a connection part body 71 and a protruding part 72. The connection part body 71 is provided between the second end of a stator vane body 41 and a diameter-enlarged part 56. The connection part body 71 is formed integrally with the second end of the stator vane body 41 and the diameter-enlarged part 56. The connection part body 71 has a shape in which a width of the connection part body 71 is wider from first end surface 41*d* of the stator vane body 41 toward a diameter-enlarged part 56.

The protruding part 72 is provided in a portion of the connection part body 71 located on a leading edge 41A side of the stator vane body 41. The protruding part 72 protrudes from the connection part body 71 toward the leading edge 41A side while in contact with the first end surface 41*d* of the stator vane body 41 on the leading edge 41A side facing an outer circumferential surface 25*a* of an inner casing 25.

The protruding part 72 includes a first guide surface 72*a* and a second guide surface 72*b*. The first guide surface 72*a* is disposed on a pressure surface 41*a* side of the stator vane body 41. The first guide surface 72*a* guides a working fluid in a direction in which a flow direction of a leakage flow is directed in a flow direction E of a main flow.

The second guide surface 72*b* is disposed on a suction surface 41*b* side of the stator vane body 41. Since The second guide surface 72*b* guides a working fluid such that the flow direction of the leakage flow is directed in a J direction, the leakage flow is minimized from flowing toward the suction surface 41*b* side.

Since the protruding part 72 having the above-mentioned constitution is provided, it is possible to prevent the main flow of the working fluid from colliding with the connection part body 71 and it is possible to guide the working fluid such that the flow direction of the leakage flow of the working fluid is directed in a flow direction E of the main flow. Thus, even when an arrangement pitch of the variable stator vane 66 is narrow, it is possible to reduce the pressure loss.

The first and second guide surfaces 72*a* and 72*b* may be, for example, disposed such that a distance between the first guide surface 72*a* and the second guide surface 72*b* is increased from a distal end portion 72A of the protruding part 72 toward a base end of the protruding part 72 (on the connection part body 71 side).

In this way, since the distance between the first guide surface 72*a* and the second guide surface 72*b* is increased from the distal end portion 72A of the protruding part 72 toward the base end of the protruding part 72 (on the connection part body 71 side), it is possible to divide the main flow of the working fluid into two flows before the working fluid collides with the connection part body 71 and to guide the working fluid using the first guide surface 72*a* such that the flow direction of the leakage flow of the working fluid which has passed on the leading edge 41A side of the stator vane body 41 is directed in the flow direction E of the main flow.

Also, a shape of the distal end portion 72A of the protruding part 72 may be, for example, a rounded shape.

In this way, since the shape of the distal end portion 72A of the protruding part 72 is a rounded shape, it is possible to prevent the damage of the distal end portion 72A of the protruding part and it is possible to smoothly guide the working fluid toward the base end side of the protruding part 72.

According to the variable stator vane 66 in the second embodiment, since the protruding part 72 including the first and second guide surfaces 72*a* and 72*b* described above is provided, it is possible to prevent the main flow of the working fluid from colliding with the connection part body 71 and it is possible to guide the working fluid in the direction in which the flow direction of the leakage flow of the working fluid is directed in the flow direction E of the main flow. Thus, even when an arrangement pitch of the variable stator vane 66 is narrow, it is possible to reduce the pressure loss.

Figure 11:
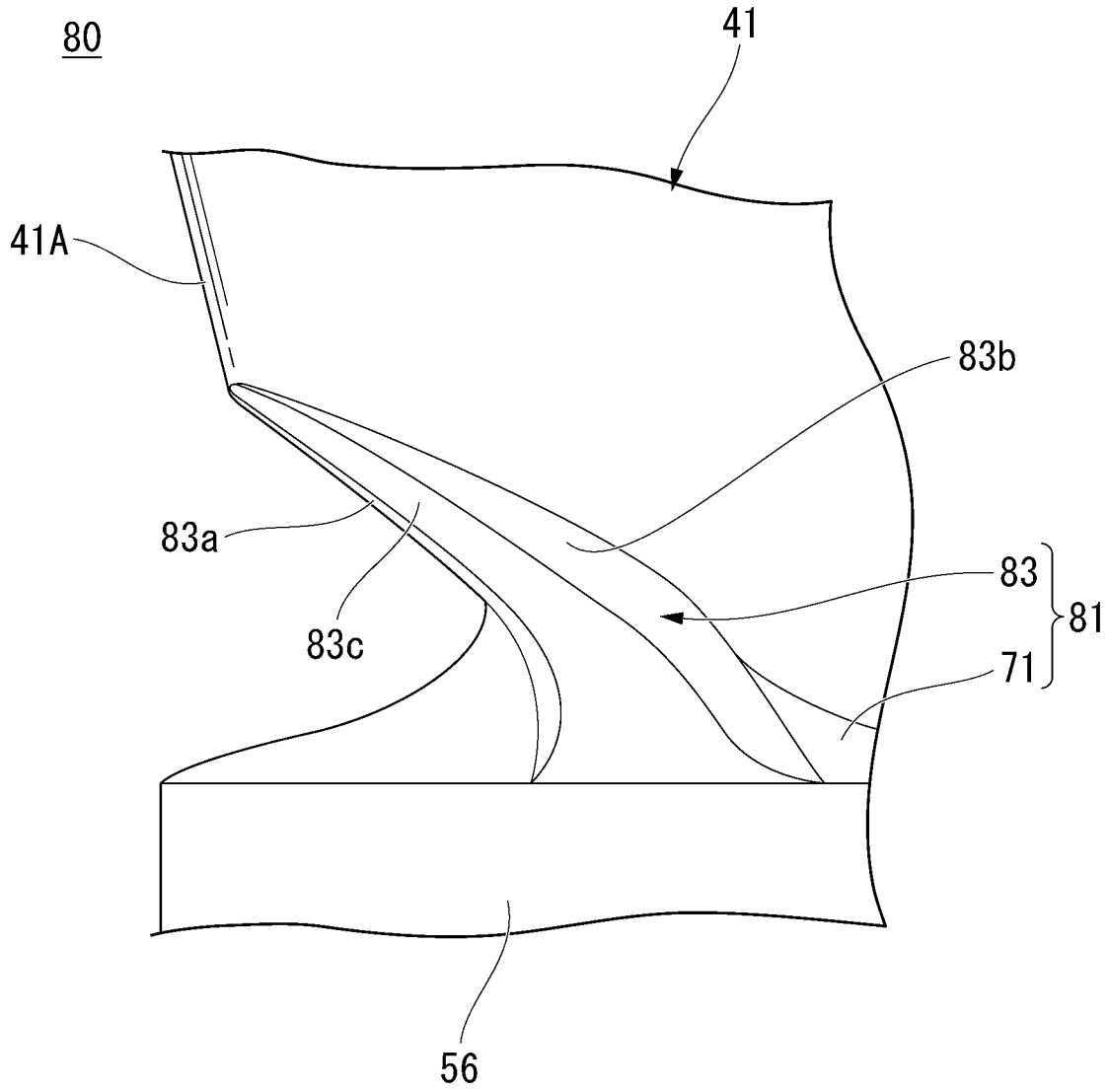
FIG. 11 is an enlarged perspective view of a main part of a variable stator vane according to a modification of the second embodiment of the present invention.

A variable stator vane 80 according to a modification of the second embodiment will be described below with reference to FIG. 11.

The variable stator vane 80 is configured in the same manner as the variable stator vane 66 except that a connection part 81 is provided instead of the connection part 67 constituting the variable stator vane 66 in the second embodiment.

The connection part 81 is configured in the same manner as the connection part 67 except that a protruding part 83 is provided instead of the protruding part 72 constituting the connection part 67 shown in the second embodiment.

The protruding part 83 is provided to cover the entire first end surface (the first end surface 41*d* shown in FIG. 2) of a stator vane body 41 on a leading edge 41A side. The protruding part 83 includes a first guide surface 83*a*, a second guide surface 83*b*, and a bottom surface 83*c*. The bottom surface 83*c* is a surface which is connected to a lower end of the first guide surface 83*a* and a lower end of the second guide surface 83*b*.

According to the variable stator vane 80 associated with the modification of the second embodiment, since the protruding part 83 which covers the entire end surface of the stator vane body 41 on the leading edge 41A side is provided, it is possible to further increase a length of the first guide surface 83*a* than that of a case in which the protruding part is provided only on a part of the end surface of the stator vane body 41 on the leading edge 41A side.

Thus, since it is possible to guide the working fluid in the direction in which the direction of the leakage flow of the working fluid is directed in the flow direction of the main flow when the working fluid has reached the leading edge 41A of the stator vane body 41, it is possible to further reduce the pressure loss.

Third Embodiment

A compressor 90 in a third embodiment will be described with reference to FIGS. 12 and 13. Constituent elements in FIG. 12 that are the same as those shown in FIGS. 8 and 11 will be denoted with the same reference numerals as those shown in FIGS. 8 and 11. Constituent element sin FIG. 13 that are the same as those shown in FIGS. 11 and 12 will be denoted will be the same reference numerals as those shown in FIGS. 11 and 12.

The compressor 90 in the third embodiment is configured in the same manner as the compressor 10 except that a variable stator vane 91 is provided and a chamfered part 96 is formed on an inner casing 25 instead of the variable stator vane 35 constituting the compressor 10 in the first embodiment.

The variable stator vane 91 is configured in the same manner as the variable stator vane 80 except that a connection part 93 is provided instead of the connection part 81 constituting the variable stator vane 80 according to the modification of the second embodiment.

The connection part 93 is configured in the same manner as the connection part 81 except that a protruding part 94 is provided instead of the protruding part 83 constituting the connection part 81 described in the modification of the second embodiment.

The protruding part 94 covers first end surface 41*d* (an end surface of a stator vane body 41 on a leading edge 41A side) and is disposed such that a part thereof extends to a side surface 56*a* of a diameter-enlarged part 56. The protruding part 94 is disposed to extend to the leading edge 41A of the stator vane body 41.

The protruding part 94 and the protruding part 83 differ in that a part of the protruding part 94 is disposed to extend to the side surface 56*a* of the diameter-enlarged part 56 and the rest of the constitution is the same as that of the protruding part 83.

Figure 12:
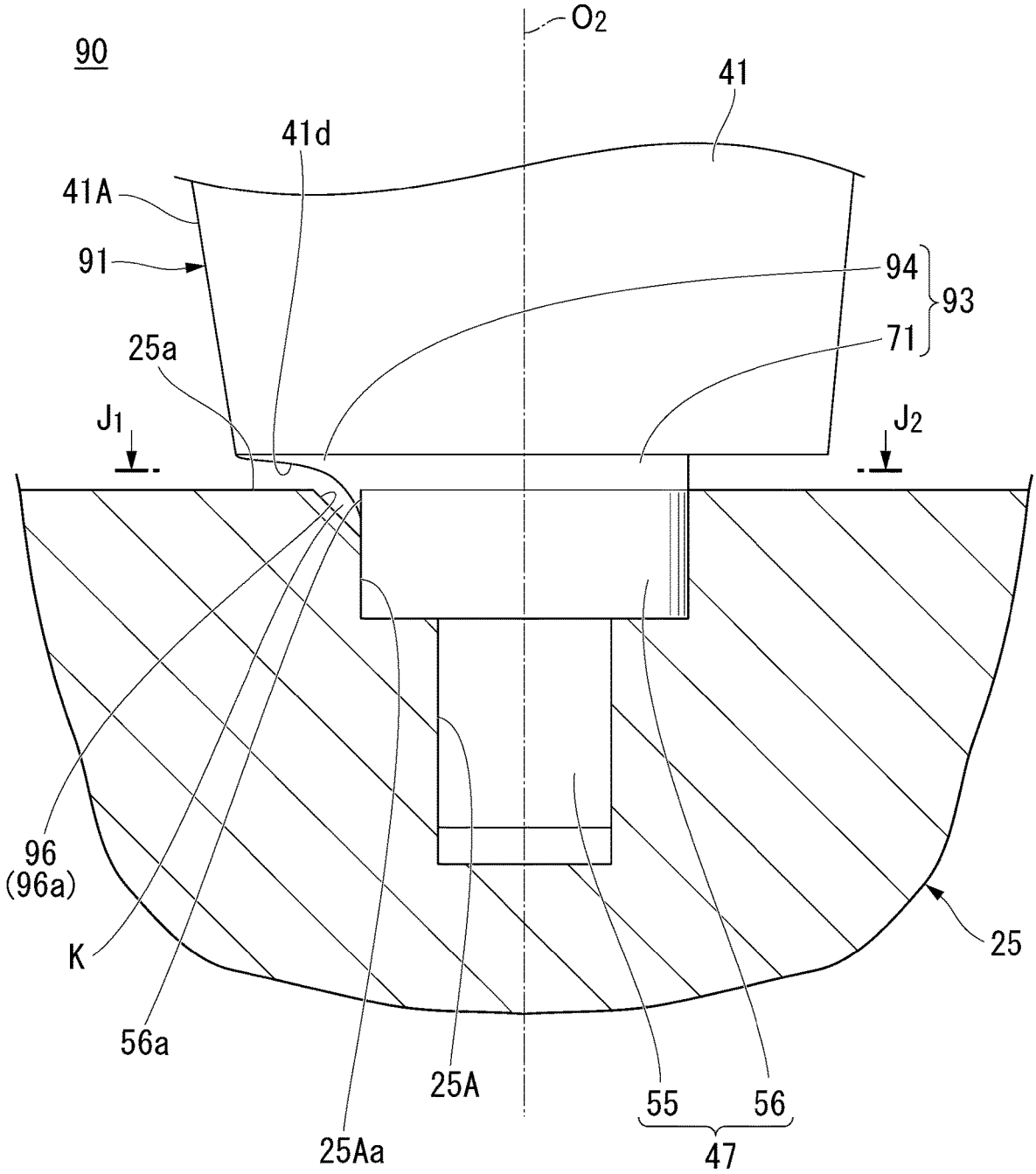
FIG. 12 is an enlarged cross-sectional view of a part of a compressor according to a third embodiment of the present invention.

A shape obtained by cutting the connection part 93 along a $J_1$-$J_2$ line shown in FIG. 12 is, for example, the same shape as the connection part 50 shown in FIG. 7, but the connection part 93 in this embodiment further extends toward a stator vane leading edge 41A side than the connection part 50 of FIG. 7. That is to say, the connection part 93 and the connection part 81 differ in that the diameter-enlarged part 56 is caused to protrude toward the stator vane leading edge 41A side.

The chamfered part 96 is formed in a portion of an outer circumferential portion of the inner casing 25 facing the protruding part 94. A gap K is formed between the protruding part 94 and the inner casing 25 due to the chamfered part 96.

The chamfered part 96 defines a part of the gap K and has a chamfered surface 96*a* facing the protruding part 94. The chamfered surface 96*a* is a surface inclined with respect to the outer circumferential surface 25*a*.

The chamfered surface 96*a* is connected to a side surface 25Aa of a shaft accommodation part 25A (specifically, a side surface of a portion of the shaft accommodation part 25A in which the diameter-enlarged part 56 is accommodated).

According to the compressor 90 in the third embodiment, since the protruding part 94 having the above-mentioned constitution is provided, it is possible to cause the working fluid in the vicinity of the outer circumferential surface 25*a* of the inner casing 25 to collide with the protruding part 94. Thus, it is possible to prevent the working fluid in the vicinity of the outer circumferential surface 25*a* of the inner casing 25 from colliding with the connection part body 71.

Also, since the chamfered part 96 having the above-mentioned constitution is provided, it is possible to guide the working fluid to the gap K. Thus, it is possible to guide the working fluid such that the flow direction of the leakage flow is more reliably directed in the flow direction of the main flow.

Figure 13:
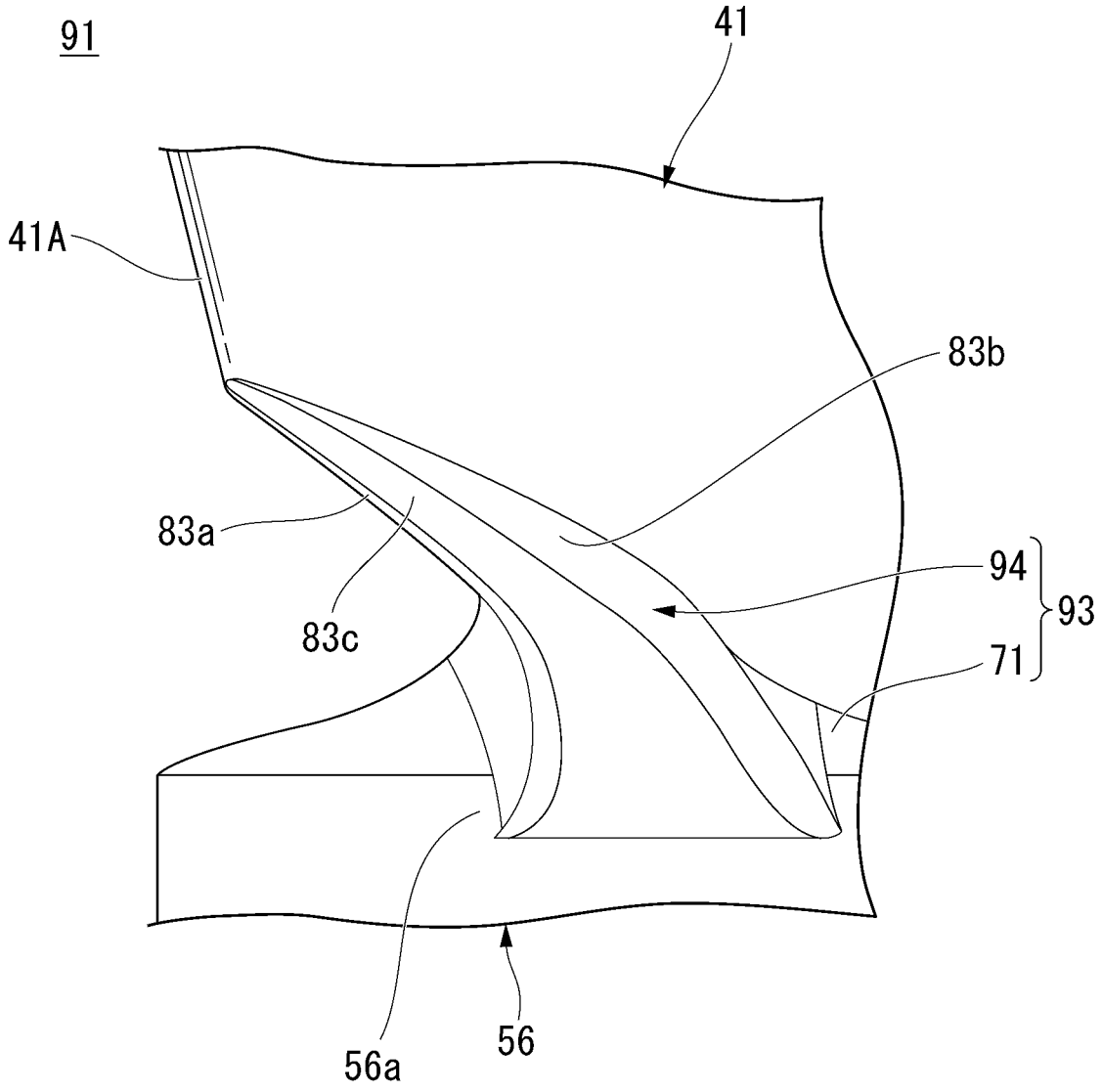
FIG. 13 is an enlarged perspective view of a main part of a variable stator vane shown in FIG. 12.

It should be noted that, although a case in which the protruding part 94 is disposed to extend to the leading edge 41A of the stator vane body 41 has been described as an example in FIGS. 12 and 13, an amount of protruding of the protruding part 94 with respect to a direction toward the leading edge 41A is not limited to the amount of protruding shown in FIGS. 12 and 13. The amount of protruding of the protruding part 94 may be, for example, ½ or ¼ of the amount of protruding shown in FIGS. 12 and 13. The amount of protruding of the protruding part 94 can be set as appropriate.

While the preferred embodiments of the present invention have been described in detail above, the present invention is not limited to such specific embodiments and various modifications and changes are possible without departing from the scope of the gist of the present invention described in the claims.

For example, although the variable stator vanes 35 and 66 supported by the rotary shafts 43 and 47 from both sides of the stator vane body 41 have been described as an example in the first and second embodiments, the present invention is also applicable to a variable stator vane in which a stator vane body 41 is supported by a rotary shaft from one side.

INDUSTRIAL APPLICABILITY

The present invention is applicable to a variable stator vane and a compressor.

REFERENCE SIGNS LIST

10, 65, 90 Compressor
11 Rotor
13 Casing
15 Variable stator vane mechanism
17 Stator vane group
21 Rotor body
23 Rotor blade
23A First rotor blade group
23B Second rotor blade group
23C Third rotor blade group
23D Fourth rotor blade group
23E Fifth rotor blade group
23F Sixth rotor blade group
25 Inner casing
25*a* Outer circumferential surface
25A, 26A Shaft accommodation part
26*a* Inner circumferential surface
26 Outer casing
27 Flow path
28 Suction port
31 Movable ring
33 Link mechanism
35, 66, 80, 91 Variable stator vane
37 Rotation driving part
41, 59 stator vane body
41*a* Pressure surface
41A Leading edge
41*b* Suction surface
41B Trailing edge
41*c* Second end surface
41*d* First end surface
43, 47 Rotary shaft
45, 48, 50, 67, 81, 93 Connection part
48*a*, 50*a*, 72*a*, 83*a* First guide surface
48A Cutout part
50*b* Surface
52, 55 Rotary shaft body
53, 56 Diameter-enlarged part
56*a* Side surface
58 Stator vane
71 Connection part body
72, 83, 94 Protruding part
72A Distal end portion
72*b*, 83*b* Second guide surface
96 Chamfered part
96*a* Chamfered surface
$CL_1$, $CL_2$ Clearance
E, F, I, J Direction
K Gap
$O_1$, $O_2$ Axis
VC Virtual circle
r Radius

What is claimed is:

1. A variable stator vane, comprising:

a stator vane body which is configured to be disposed in a flow path through which a working fluid flows and by which a clearance is configured to be formed between the stator vane body and an inner casing;

a rotary shaft which is configured to rotate such that an angle of the stator vane body with respect to a flow direction of a main flow of the working fluid varies; and a connection part which connects the stator vane body and the rotary shaft, wherein the stator vane body has a first end surface located in a portion closest to a leading edge of the stator vane body and facing an outer circumferential surface of the inner casing, wherein at least a portion of the clearance is formed between the first end surface and the outer circumferential surface of the inner casing, wherein the connection part includes:

a first guide surface which is configured to guide a leakage flow of the working fluid which has flowed into a side closer to the portion of the clearance formed between the first end surface and the outer circumferential surface of the inner casing so that a flow direction of the leakage flow is directed to a flow direction of the main flow;

a connection part body which connects the stator vane body and the rotary shaft; and a protruding part which is provided in the portion closest to the leading edge of the stator vane body with respect to the connection part body, protrudes from the connection part body while in contact with the first end surface, and includes the first guide surface, wherein the protruding part includes a second guide surface disposed at a position close to a pressure surface of the stator vane body, and wherein the first and second guide surfaces are formed such that a distance between the first guide surface and the second guide surface increases from a distal end of the protruding part toward a base end of the protruding part.

2. The variable stator vane according to claim 1, wherein the first guide surface is disposed in a portion of the connection part which is close to the leading edge of the stator vane body and close to a suction surface side of the stator vane body.

3. The variable stator vane according to claim 1, wherein the first guide surface is a curved surface which protrudes so as to approach a suction surface of the stator vane body.

4. The variable stator vane according to claim 1, wherein a shape of a distal end portion of the protruding part is a rounded shape.

5. The variable stator vane according to claim 1, wherein the protruding part is provided to cover an entirety of the first end surface closest to the leading edge of the stator vane body.

6. The variable stator vane according to claim 1, wherein the rotary shaft includes a rotary shaft body and a diameter-enlarged part which connects the rotary shaft body and the connection part and has a diameter larger than an outer diameter of the rotary shaft body, and the connection part has a shape in which a width of the connection part is wider from the stator vane body toward the diameter-enlarged part.

7. The variable stator vane according to claim 1, wherein the rotary shaft includes a rotary shaft body and a diameter-enlarged part which connects the rotary shaft body and the connection part and has a diameter larger than an outer diameter of the rotary shaft body, and the protruding part is provided to cover at least a part of the first end surface closest to the leading edge of the stator vane body and is disposed to extend toward a side surface of the diameter-enlarged part.

8. A compressor, comprising:

the variable stator vane according to claim 7;

a rotor which includes a rotor body and a plurality of rotor blades arranged in an axial direction and a circumferential direction of the rotor body;

the inner casing provided outside the rotor;

an outer casing provided outside the inner casing; and a rotation driving part which is connected to the rotary shaft and is configured to rotate the rotary shaft, wherein the inner casing includes a shaft accommodation part which has the rotary shaft accommodated therein and a chamfered part which defines a gap between the protruding part and the inner casing, and a chamfered surface of the chamfered part is connected to a side surface of the shaft accommodation part.

9. A compressor, comprising:

the variable stator vane according to claim 1;

a rotor which includes a rotor body and a plurality of rotor blades arranged in an axial direction and a circumferential direction of the rotor body;

the inner casing provided outside the rotor;

an outer casing provided outside the inner casing; and a rotation driving part which is connected to the rotary shaft and is configured to rotate the rotary shaft, wherein the inner casing includes a shaft accommodation part which has the rotary shaft accommodated therein.

10. The compressor according to claim 9, wherein the variable stator vane includes another rotary shaft which is connected to the stator vane body located on a side opposite from a side on which the rotary shaft is provided and rotatably supported by the outer casing.

11. A variable stator vane, comprising:

a stator vane body which is configured to be disposed in a flow path through which a working fluid flows and by which a clearance is configured to be formed between the stator vane body and an inner casing;

a rotary shaft which is configured to rotate such that an angle of the stator vane body with respect to a flow direction of a main flow of the working fluid varies; and a connection part which connects the stator vane body and the rotary shaft, wherein the stator vane body has a first end surface is located in a portion closest to a leading edge of the stator vane body and facing an outer circumferential surface of the inner casing, wherein at least a portion of the clearance is formed between the first end surface and the outer circumferential surface of the inner casing, wherein the connection part includes a first guide surface which is configured to guide a leakage flow of the working fluid which has flowed into a side closer to the portion of clearance is formed between the first end surface and the outer circumferential surface of the inner casing so that a flow direction of the leakage flow is directed to a flow direction of the main flow;

a connection part body which connects the stator vane body and the rotary shaft; and a protruding part which is provided in the portion closest to the leading edge of the stator vane body with respect to the connection part body, protrudes from the connection part body while in contact with the first end surface, and includes the first guide surface, and wherein the protruding part is provided to cover an entirety of the first end surface closest to the leading edge of the stator vane body.

12. A compressor, comprising:

a variable stator vane;

a rotor which includes a rotor body and a plurality of rotor blades arranged in an axial direction and a circumferential direction of the rotor body;

an inner casing provided outside the rotor;

an outer casing provided outside the inner casing; and a rotation driving part which is connected to a rotary shaft of variable stator vane and is configured to rotate the rotary shaft, wherein the variable stator vane includes a stator vane body which is configured to be disposed in a flow path through which a working fluid flows and by which a clearance is configured to be formed between the stator vane body and the inner casing;

the rotary shaft, wherein the rotary is configured to rotate such that an angle of the stator vane body with respect to a flow direction of a main flow of the working fluid varies; and a connection part which connects the stator vane body and the rotary shaft, wherein the stator vane body has a first end surface is located in a portion closest to a leading edge of the stator vane body and facing an outer circumferential surface of the inner casing, wherein at least a portion of the clearance is formed between the first end surface and the outer circumferential surface of the inner casing, wherein the connection part includes a first guide surface which is configured to guide a leakage flow of the working fluid which has flowed into a side closer to the portion of clearance is formed between the first end surface and the outer circumferential surface of the inner casing-so that a flow direction of the leakage flow is directed to a flow direction of the main flow;

a connection part body which connects the stator vane body and the rotary shaft; and a protruding part which is provided in the portion closest to the leading edge of the stator vane body with respect to the connection part body, protrudes from the connection part body while in contact with the first end surface, and includes the first guide surface, wherein the rotary shaft includes a rotary shaft body and a diameter-enlarged part which connects the rotary shaft body and the connection part and has a diameter larger than an outer diameter of the rotary shaft body, wherein the protruding part is provided to cover at least a part of the first end surface closest to the leading edge of the stator vane body and is disposed to extend toward a side surface of the diameter-enlarged part, wherein the inner casing includes a shaft accommodation part which has the rotary shaft accommodated therein and a chamfered part which defines a gap between the protruding part and the inner casing, and wherein a chamfered surface of the chamfered part is connected to a side surface of the shaft accommodation part.

* * * * *